US009341365B2

(12) United States Patent
Gan

(10) Patent No.: US 9,341,365 B2
(45) Date of Patent: May 17, 2016

(54) EVERSIBLE CANDLE HOLDER

(71) Applicant: Daniel L. Gan, Castro Valley, CA (US)

(72) Inventor: Daniel L. Gan, Castro Valley, CA (US)

( * ) Notice: Subject to any disclaimer, the term of this patent is extended or adjusted under 35 U.S.C. 154(b) by 486 days.

(21) Appl. No.: 13/740,059

(22) Filed: Jan. 11, 2013

(65) Prior Publication Data

US 2013/0183629 A1 Jul. 18, 2013

Related U.S. Application Data

(60) Provisional application No. 61/586,091, filed on Jan. 12, 2012.

(51) Int. Cl.
*F21V 35/00* (2006.01)
*F21V 29/00* (2015.01)
*F21V 29/89* (2015.01)

(52) U.S. Cl.
CPC ..... *F21V 35/00* (2013.01); *F21V 29/20* (2013.01); *F21V 35/003* (2013.01); *F21V 29/89* (2015.01)

(58) Field of Classification Search
CPC ..... F21V 35/003; F21V 35/006
USPC ..... 431/292, 297; 249/127; 425/440, 803
See application file for complete search history.

(56) References Cited

U.S. PATENT DOCUMENTS

| | | | | | |
|---|---|---|---|---|---|
| 335,020 | A | | 1/1886 | Damerel | |
| 1,017,375 | A | | 2/1912 | Bourgeois | |
| 2,025,096 | A | * | 12/1935 | Deckert | 431/291 |
| 2,809,512 | A | * | 10/1957 | Hartnett | 431/294 |
| 3,483,908 | A | * | 12/1969 | Donovan | 221/260 |
| 3,583,853 | A | | 6/1971 | Schramm | |
| 3,752,433 | A | * | 8/1973 | Berman | 249/94 |
| 3,974,996 | A | * | 8/1976 | Violet | 249/112 |
| 4,076,207 | A | * | 2/1978 | Austin | 249/66.1 |
| 5,683,239 | A | | 11/1997 | Cardosi | |
| 5,939,005 | A | * | 8/1999 | Materna | 264/255 |
| 6,428,310 | B1 | * | 8/2002 | Nicholas G. | 431/291 |
| 6,457,969 | B1 | | 10/2002 | Khosla | |
| 6,648,631 | B2 | | 11/2003 | Wright et al. | |
| 6,793,193 | B2 | * | 9/2004 | de Groote | 249/119 |
| 6,797,223 | B2 | | 9/2004 | Beale et al. | |
| 7,247,017 | B2 | | 7/2007 | Furner | |
| 7,607,915 | B2 | * | 10/2009 | Adair et al. | 431/292 |
| 7,731,150 | B2 | | 6/2010 | Campbell | |

(Continued)

FOREIGN PATENT DOCUMENTS

SE 534184 5/2011

*Primary Examiner* — Avinash Savani
*Assistant Examiner* — Deepak Deean
(74) *Attorney, Agent, or Firm* — Brian Beverly; Beeson Skinner Beverly, LLP

(57) ABSTRACT

An eversible candle holder comprises a flexible generally cylindrical body capable of being manipulated between rest and everted configurations, the body having sidewalls extending upwardly from a base. In the rest configuration the central portion of a heat sink is seated on a central pedestal of the base and a horizontal lip extending from a skirt wall depending from the pedestal's central portion is disposed in an inwardly-facing recess in a recessed perimeter portion of the base and is locked in the recess by an overlapping inwardly-extending retaining flange. In an everted configuration, the locking flange is rotated outwardly about an annular hinge section away from the central pedestal opening the recess a sufficient width to release the lip, enabling removal of the heat sink from the base, and facilitating disposal of candle wax accumulated in the bottom of the holder.

9 Claims, 4 Drawing Sheets

(56) References Cited

U.S. PATENT DOCUMENTS

2002/0127507 A1* 9/2002 Long ..... 431/291
2005/0208447 A1 9/2005 Kubicek et al.
2005/0266367 A1* 12/2005 Kay et al. ..... 431/291
2006/0093980 A1 5/2006 Kubicek et al.
2008/0070174 A1* 3/2008 Moeller ..... 431/289
2010/0311000 A1 12/2010 Hagglund et al.

* cited by examiner

EVERSIBLE CANDLE HOLDER

CROSS-REFERENCE TO RELATED APPLICATIONS

This application claims the benefit of U.S. Provisional Application No. 61/586,091, filed Jan. 12, 2012, which is incorporated herein by reference.

BACKGROUND

1. Field of Use

This invention relates to candle holders, and in particular to a candle holder primarily intended for use with a tea light or votive candle that is fully eversible to facilitate removal of accumulated wax in the bottom of the container. The invention also relates to a flexible candle holder in the bottom of which is provided a metal heat sink to prevent damage to the holder and to avoid marring surfaces upon which the holder is placed.

2. Description of Related Art

Votive candles are frequently used for atmospheric lighting and in religious ceremonies. A votive candle is typically placed directly on a support surface, and the candle is then lit. This results in wax dripping on the surface as the candle burns down, necessitating removal of the wax residue and cleaning of the surface. Another common problem is that as the candle burns down, the surface on which it rests can become scorched or discolored. Therefore, votive candles are often placed in a variety of candle holders which contain the wax as the candle burns down but still reveal light from the candle flame. Unfortunately, wax residue that collects in the bottom of the holder can be difficult to remove so that the holder can be reused. Furthermore, since some candle holders readily transmit heat, as the candle burns to the bottom of the container, heat from the flame can scorch or discolor the surface on which the candle holder is placed.

An improved votive candle holder is needed which contains the wax drippings that develop as the candle burns down, transmits light from the candle flame, does not scorch the surface upon which it rests as the candle burns low, is itself heat-resistant, reusable, and facilitates removal of wax residue in the bottom of the container after the candle has burned all the way down.

SUMMARY OF THE INVENTION

An eversible candle holder comprises a flexible generally cylindrical body capable of being manipulated between rest and everted configurations. The body has a base and sidewalls extending upwardly from the base. The base includes a central pedestal and a recessed annular perimeter portion surrounding the pedestal. An annular retaining groove surrounds and is formed in part from the sloped walls of the pedestal. A support collar is joined to the pedestal by an annual hinge section which permits the support collar to rotate with respect to the pedestal. An annular locking flange extends inwardly from the support collar and, with the hinge section, defines an inwardly facing recess.

A heat sink has a central portion, a skirt wall depending from the central portion, and a horizontal lip extending outwardly from the bottom edge of the skirt wall.

In the rest configuration the central portion of the heat sink is seated on the central pedestal of the base, the skirt wall is disposed in the annular retaining groove, and the heat sink's horizontal lip is retained in the recess. The locking flange overlaps and retains the lip in the recess so that the heat sink is secured to the base even when the holder is inverted.

In the everted configuration the locking flange is rotated outwardly and way from the pedestal about the annular hinge section which opens the recess to a width that is sufficient width to release the lip and enables removal of the heat sink from the base. With the holder's body fully everted, disposal of candle wax accumulated in the bottom of the holder is greatly facilitated.

BRIEF DESCRIPTION OF THE ILLUSTRATIONS

DETAILED DESCRIPTION OF THE ILLUSTRATED EMBODIMENT

Figure 1:
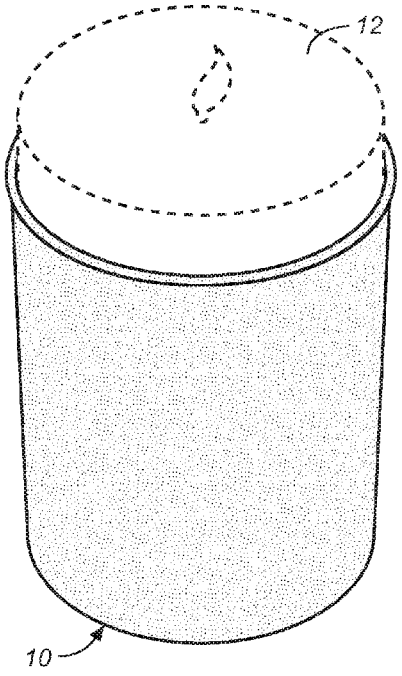
FIG. 1 is an upper perspective view of a candle holder according to the invention showing a votive candle disposed in the holder.

An eversible candle holder according to the invention is referred to generally at 10 in FIG. 1. It is anticipated that the eversible candle holder will typically be used with a votive candle 12 (shown in broken lines). However, it should be understood that the invention is not intended to be limited to use only with votive candles, but rather embraces candle holders of widely varying sizes for use with candles of virtually any size and configuration.

Figure 2:
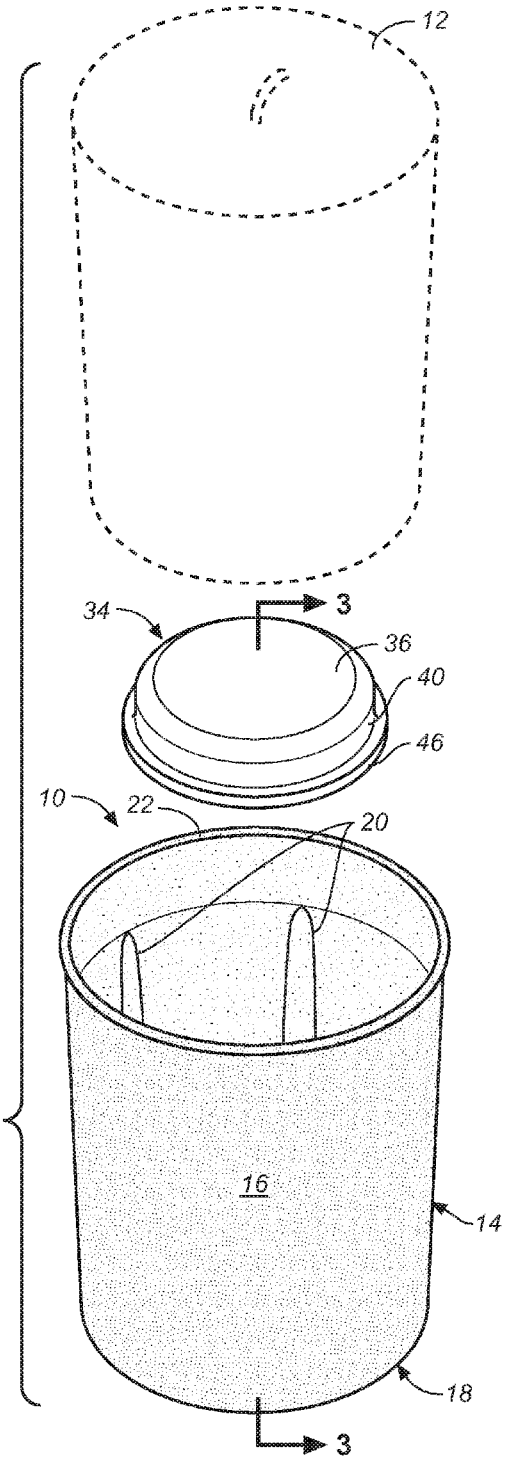
FIG. 2 is an exploded upper perspective view of the candle holder of FIG. 1.
Figure 3:
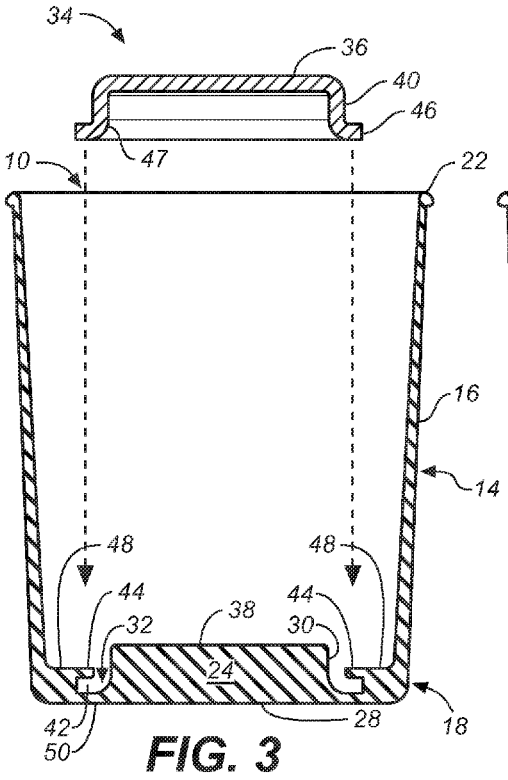
FIG. 3 is an exploded side section view of the candle holder taken along lines 3-3 of FIG. 2, but omitting the votive candle.
Figure 4:
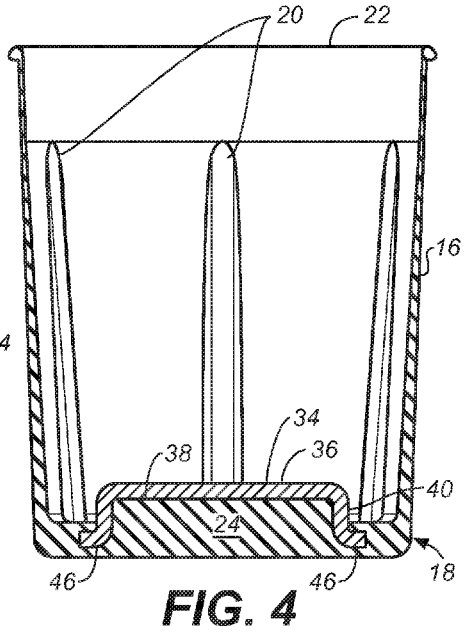
FIG. 4 is a side sectional view of the candle holder similar to FIG. 3, but showing the heat sink positioned on the pedestal of the base.
Figure 5:
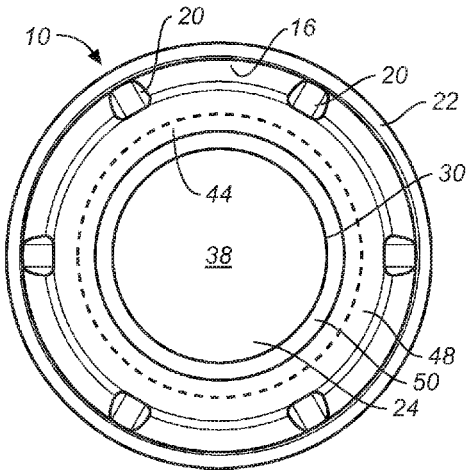
FIG. 5 is a top plan view thereof.
Figure 6:
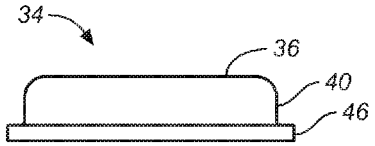
FIG. 6 is a side elevational view of the heat sink of the candle holder.

With reference now to FIGS. 2-4, it is seen that the candle holder comprises a generally cup-shaped body 14 having side walls 16 extending upwardly from a base 18. A plurality of interior reinforcing ribs 20 on side walls 16 extend upwardly from the base 18 nearly to the top of the side walls to provide added strength and rigidity to the side walls. In the illustrated embodiment, it is seen that the ribs 20 extend upwards substantially the full height of the side walls, but it will be understood that the reinforcing ribs may extend all the way to the rim 22 or to some height short of the rim. The rim 22 is also thicker than the side walls, providing added strength and rigidity to the top of the side walls.

As seen in FIG. 3, the base 18 of the body 14 comprises a centrally located raised pedestal 24 surrounded by a recessed annular perimeter portion 26. The downward sloping sides 30 of the pedestal 24 extend into an annular retaining groove 32 surrounding the central pedestal 24. The heat sink 34, shown above the body 14 of the holder, has a flat central portion 36, a skirt wall 40 depending downwardly from the central portion, and a horizontal lip 46 which extends outwardly from the lower end 47 of the skirt wall.

The body 14 and heat sink 34 are shown as assembled in FIG. 4. The heat sink 34 rests on pedestal 24, the central portion 36 thereof seated on the pedestal's top surface 38, and skirt wall 40 fitting snugly against the sides 30 of the pedestal 24 and extending into retaining groove 32. The bottom end of groove 32 forms inwardly-facing recess 42 bounded on its top side by annular overlapping locking flange 44. Horizontal lip 46 is received in recess 42 and locking flange 44 captures the lip 46 in retaining groove 32, thereby securing the heat sink 34 in position on the pedestal 24 and in base 18.

The heat sink 34 has several advantages. First, it provides a stable, flat base upon which to place a candle in the holder. Second, as the candle burns low, the metal heat sink spreads the heat generated by the candle flame, thereby avoiding creation of a hot spot which could damage the bottom of the container. Third, the added thickness of the pedestal 24 relative to recessed perimeter portion 26 more effectively blocks transmission of heat thereby avoiding marring of the surface upon which the holder may be resting. Finally, the heat sink 34 draws heat away from the flame of a low-burning candle and into the surrounding skirt wall. The amount of heat transmitted to the skirt wall 40 and lip 46 at the periphery of the heat sink 34 is insufficient to damage the base 18, and in particular the structure of the retaining groove 32.

It is anticipated that the body of the holder will be manufactured from a suitable vinyl material that is not only heat resistant, but sufficiently flexible to allow the container to be completely everted, while being sturdy enough to maintain its shape when holding a candle.

Figure 7B:
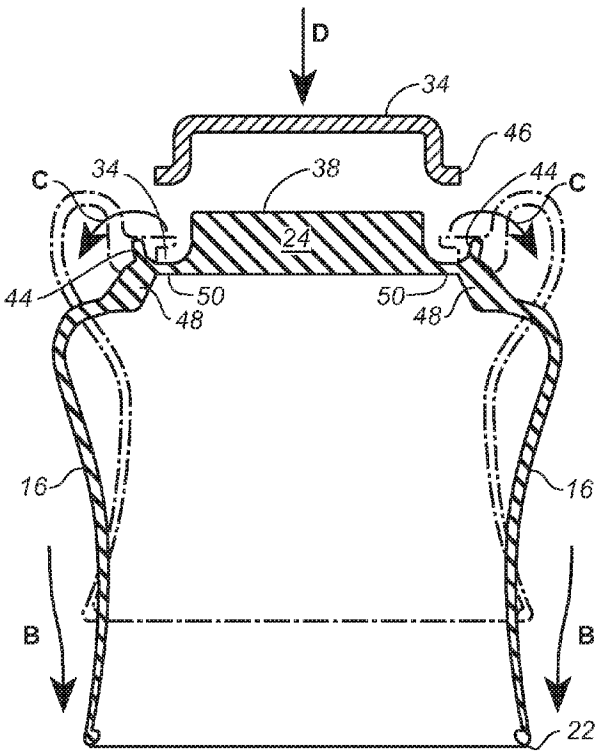
FIG. 7B is a side sectional view of the candle holder shown in a fully everted configuration with the heat sink positioned above the pedestal.
Figure 7A:
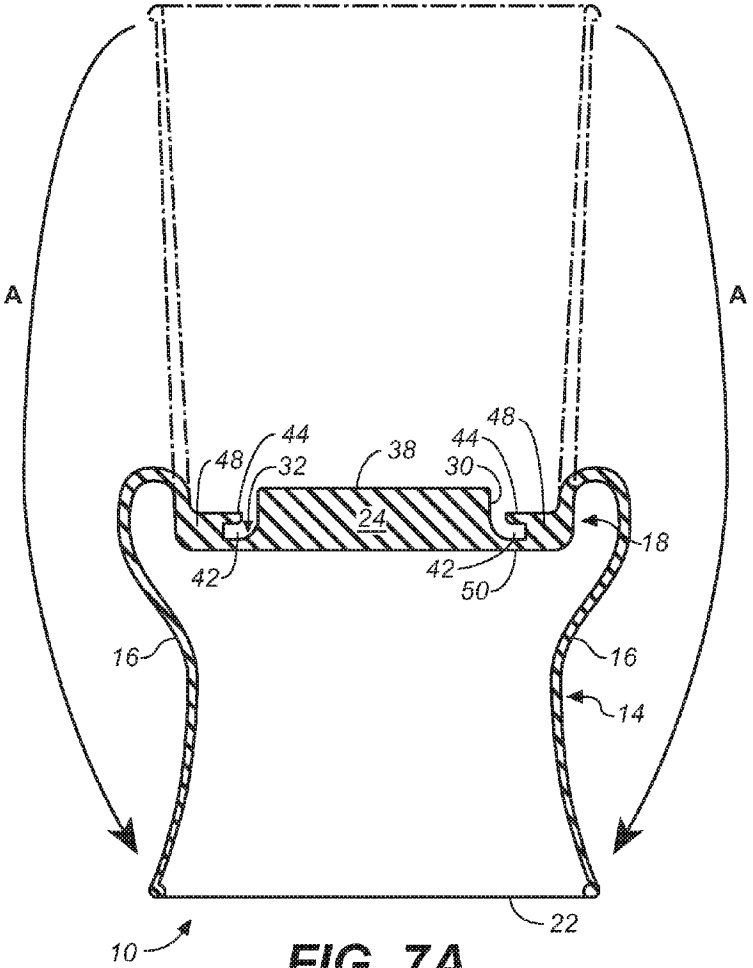
FIG. 7A is a side sectional view of the candle holder shown in a partially everted configuration.

With reference now to FIGS. 7A and 7B, it will be seen that one of the primary advantages of the invention is that the candle holder is completely eversible, that is, it can be turned inside out from a rest configuration to an everted configuration without structural damage. As first seen in FIG. 7A, from a rest configuration the side walls 16 of the holder can be turned back upon themselves to a partly everted configuration, as indicated by arrows A, to provide access to the interior of the base 18 and heat sink 34. However, it can be seen that the heat sink 34 could not in such configuration be properly positioned because the heat sink's lip 46 cannot be inserted into recess 42 access to which is blocked by overhanging flange 44.

However, from the partly everted configuration shown in FIG. 7A, the side walls 16 can be pulled further downwards, as indicted by arrows B, so as to evert the candle holder fully as shown in FIG. 7B. In manipulating the holder from the partly everted configuration to the fully everted configuration, it can be seen that the support collar 48 rotates about a relatively thin annular hinge section 50, which extends between and joins the pedestal 24 and surrounding support collar 48, in the direction indicated by arrows C. In this manner, the hinge section 50 forms a flexible joint about which the support collar 48 rotates as the holder is manipulated between the partial and fully everted configurations. In the fully everted configuration locking flange 44 has rotated outwardly and away from pedestal 24 thereby opening recess 42 upwardly and fully exposing the pedestal 24. When the holder is manipulated into the fully everted configuration, the heat sink 34 may be positioned on the pedestal with its skirt wall 40 and outwardly facing lip 46 deposed in the retaining groove 32 and recess 42, respectively, as indicated by arrow D. Reversing the process, thus manipulating the holder from the fully everted configuration shown in FIG. 7B to the partially everted configuration shown in FIG. 7A, will close the recess 42 and rotate the locking flange 44 over the outwardly facing lip 46 of the heat sink 34, thereby locking the lip 46 in recess 42, holding the skirt wall 40 in retaining groove 32, and securing the heat sink 34 in place on the pedestal 24.

Figure 8C:
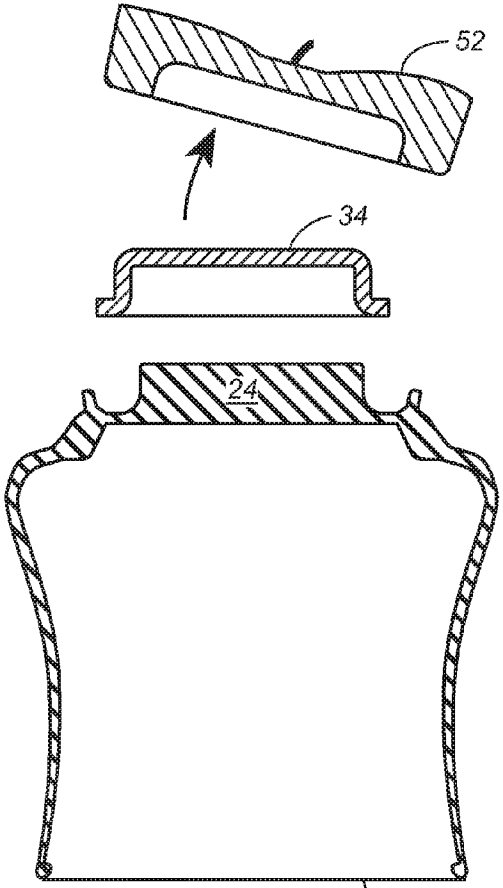
FIGS. 8A-8C are side sectional views of the candle holder shown in partially and fully everted configurations and illustrating removal of the heat sink and residual wax from the base of the candle holder.
Figure 8B:
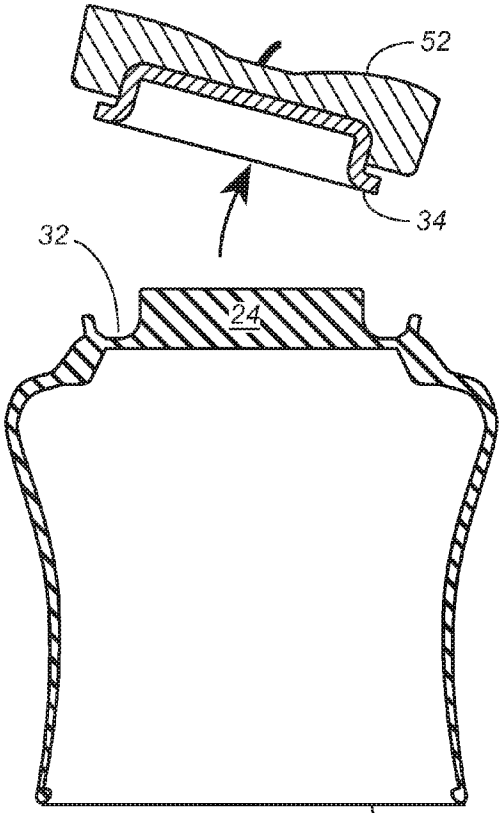
Figure 8A:
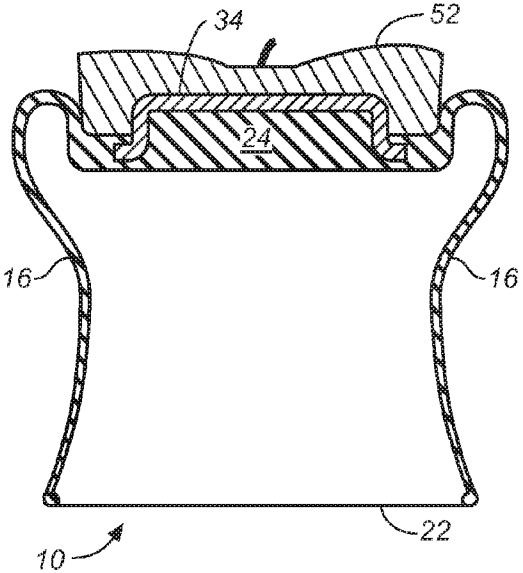

In ordinary usage, after a candle that has been placed in the holder has fully burned down, the sidewalls 16 of the candle holder can be turned inside out, as shown in FIG. 8A, thereby exposing the wax residue 52. In this position, the heat sink 34 and any accumulated wax residue 52 in the bottom of the candle holder can easily be removed as shown in FIG. 8B. This is made especially easy by the malleable nature of the vinyl material comprising the base and side walls of the candle holder, flexing of which will cause it to separate from any relatively rigid wax collected in the bottom of the container. Thereafter, any residual wax 52 that is still attached to the heat sink 34 can be separated from it as shown in FIG. 8C.

A completely eversible candle holder, as described above, thus has numerous advantages. The candle holder is completely eversible, thereby facilitating exposure of the bottom of the candle holder for ready removal of any accumulated wax in the holder resulting from a used candle. A removable protective heat sink can be locked in place in the base of the candle holder by securing the outwardly facing horizontal lip at the bottom of the skirt portion of the heat sink in the groove at the bottom of the base. The vinyl material used to make the body of the candle holder is not only flexible, but transparent, durable, and reusable for burning multiple candles. The heat sink in combination with the raised pedestal disperses heat generated by a low-burning flame thereby avoiding damage to the candle holder and preventing the surface upon which the candle holder is placed from being scorched or disfigured.

There have thus been described and illustrated certain preferred embodiments of an eversible candle holder according to the invention. Although the present invention has been described and illustrated in detail, it is clearly understood that the same is by way of illustration and example only and is not to be taken by way of limitation, the spirit and scope of the present invention being limited only by the terms of the appended claims and their legal equivalents.

I claim:

1. An eversible candle holder comprising:

a flexible body having a base and sidewalls, said body capable of being manipulated between rest and everted configurations, said base having a center pedestal and a perimeter portion surrounding said pedestal, said perimeter portion having a support collar surrounding said pedestal, a hinge section pivotally interconnecting said pedestal and said support collar, and a locking flange extending inwardly from said support collar and spaced above said hinge section, said support collar, said hinge section and said locking flange defining an inwardly-facing recess adjacent said support collar, the sidewalls of said body extending upwardly from said support collar, a removable heat sink having a flat central portion, a skirt wall, and a horizontal retaining lip, said skirt wall depending downwardly from and surrounding said central portion, said skirt wall having a lower end disposed below said central portion, said retaining lip extending outwardly from the lower end of said skirt wall, wherein, when said body is in said rest configuration, the central portion of said heat sink is seated on said pedestal and the lip of said heat sink is captured in the recess formed in said base such that said heat sink is locked in position on said pedestal, and when said body is manipulated into said everted configuration, said support collar is rotated downwardly and said locking flange is rotated away from said pedestal such that said recess is radially expanded sufficiently to enable the retaining lip of said heat sink to be released therefrom for removal of said heat sink from said base.

2. The eversible candle holder of claim 1 wherein:

said body is cup-shaped.

3. The eversible candle holder of claim 1 wherein:

said pedestal has a top surface and said perimeter portion has a floor that is recessed below said top surface.

4. The eversible candle holder of claim 1 further comprising:

a retaining groove surrounding said pedestal, and said recess is in communication with said groove.

5. The eversible candle holder of claim 1 further comprising:

a retaining groove surrounding said pedestal, wherein, when the central portion of said heat sink is seated on said pedestal, said skirt wall is disposed in said retaining groove.

6. The eversible candle holder of claim 1 wherein:

said body is constructed from vinyl.

7. An eversible candle holder comprising:

a flexible cylindrical body having a base and sidewalls, said body capable of being manipulated between rest and everted configurations, said base having a center pedestal and an annular perimeter portion surrounding said pedestal, said perimeter portion having a support collar, an annular hinge section, and an annular locking flange, the sidewalls of said body extending upwardly from said support collar, said support collar pivotally attached to said pedestal about said hinge section, said locking flange extending inwardly from said support collar and spaced above said hinge section, and said support collar, said hinge section and said locking flange defining an inwardly-facing recess adjacent said support collar, a removable heat sink having a flat central portion, a skirt wall depending downwardly from said central portion, and a horizontal retaining lip extending outwardly from said skirt wall below said central portion, wherein, when said body is in said rest configuration, the central portion of said heat sink is seated on said pedestal and the lip of said heat sink is captured in the recess of said base such that said heat sink is locked in position on said pedestal, and when said body is manipulated into said everted configuration, said support collar is rotated downwardly and said locking flange is rotated away from said pedestal such that said recess is radially expanded sufficiently to enable the retaining lip of said heat sink to be released therefrom for removal of said heat sink from said base.

8. An eversible candle holder comprising:

a flexible cylindrical body having a base and sidewalls, said body capable of being manipulated between rest and everted configurations, said base having a center pedestal and an annular perimeter portion surrounding said pedestal, said pedestal having a top surface, said perimeter portion having a floor, an annular retaining groove, a support collar, an annular hinge section, and an annular locking flange, said floor recessed below the top surface of said pedestal, said retaining groove surrounding said pedestal, the sidewalls of said body extending upwardly from said support collar, said support collar pivotally attached to said pedestal about said hinge section, said locking flange extending inwardly from said support collar and spaced above said hinge section, and said support collar, said hinge section and said locking flange defining an inwardly-facing annular recess adjacent said support collar, a removable heat sink having a flat central portion, a skirt wall surrounding and depending downwardly from and having a lower end disposed below said central portion, and a horizontal retaining lip extending outwardly from said said lower end, wherein, when said body is in said rest configuration, the central portion of said heat sink is seated on the top surface of said pedestal, the skirt wall of said heat sink is disposed in said retaining groove, and the lip of said heat sink is captured in the recess of said base, such that said heat sink is locked in position on said pedestal, and when said body is manipulated into said everted configuration, said support collar is rotated downwardly and said locking flange is rotated away from said pedestal such that said recess is radially expanded sufficiently to enable the retaining lip of said heat sink to be released therefrom for removal of said heat sink from said base.

9. The eversible candle holder of claim 1 wherein:

said pedestal is formed for resting on a support surface.

* * * * *